US011235585B2

(12) United States Patent
Cowger

(10) Patent No.: US 11,235,585 B2
(45) Date of Patent: Feb. 1, 2022

(54) LIQUID DELIVERY SYSTEM FOR AN INKJET TYPE DISPENSER

(71) Applicant: Hewlett-Packard Development Company, L.P., Spring, TX (US)

(72) Inventor: Bruce Cowger, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 84 days.

(21) Appl. No.: 16/766,109

(22) PCT Filed: Jul. 4, 2018

(86) PCT No.: PCT/US2018/040831
§ 371 (c)(1),
(2) Date: May 21, 2020

(87) PCT Pub. No.: WO2020/009699
PCT Pub. Date: Jan. 9, 2020

(65) Prior Publication Data
US 2020/0353754 A1 Nov. 12, 2020

(51) Int. Cl.
*B41J 2/175* (2006.01)
*B41J 3/36* (2006.01)

(52) U.S. Cl.
CPC ..... *B41J 2/17596* (2013.01); *B41J 3/36* (2013.01)

(58) Field of Classification Search
CPC ..... B41J 2/17596; B41J 3/36
See application file for complete search history.

(56) References Cited

U.S. PATENT DOCUMENTS

| | | | | |
|---|---|---|---|---|
| 4,310,107 | A | 1/1982 | Wesner | |
| 5,596,354 | A * | 1/1997 | Murphy | B41J 2/16532 347/30 |
| 5,825,995 | A | 10/1998 | Wiklof et al. | |
| 7,033,007 | B2 | 4/2006 | Seetho | |
| 7,431,424 | B2 | 10/2008 | Silverbrook et al. | |
| 7,708,391 | B2 | 5/2010 | Silverbrook | |
| 8,622,539 | B2 | 1/2014 | Schwartz et al. | |
| 8,960,868 | B1 | 2/2015 | Turgeman | |
| 9,272,523 | B2 | 3/2016 | Sanaei et al. | |
| 2001/0013884 | A1 | 8/2001 | Crystal et al. | |
| 2010/0134570 | A1 | 6/2010 | Yuen | |
| 2011/0109678 | A1 | 5/2011 | Schwartz et al. | |

FOREIGN PATENT DOCUMENTS

| | | | |
|---|---|---|---|
| CN | 206400566 | U | 8/2017 |
| EP | 0036295 | A2 | 9/1981 |
| EP | 2978605 | B1 | 3/2018 |

* cited by examiner

*Primary Examiner* — Justin Seo
(74) *Attorney, Agent, or Firm* — HP Inc. Patent Department

(57) ABSTRACT

In one example, a liquid delivery system for an inkjet type dispenser includes a reservoir to hold liquid, a chamber downstream from the reservoir, a one-way valve to allow the flow of liquid from the reservoir into the chamber and to block the flow of liquid from the chamber back into the reservoir, and a manually actuated pump to pull liquid from the reservoir into the chamber through the valve and to push liquid from the chamber toward a printhead.

13 Claims, 6 Drawing Sheets

LIQUID DELIVERY SYSTEM FOR AN INKJET TYPE DISPENSER

BACKGROUND

Handheld inkjet printers are commonly used to print bar codes on packaging and shipping materials.

DRAWINGS

FIGS. 1-4 present a sequence of views illustrating the structure and operation of an example liquid delivery system for a handheld printer or other inkjet type dispenser.

The same part numbers designate the same or similar parts throughout the figures.

DESCRIPTION

Figure 1:
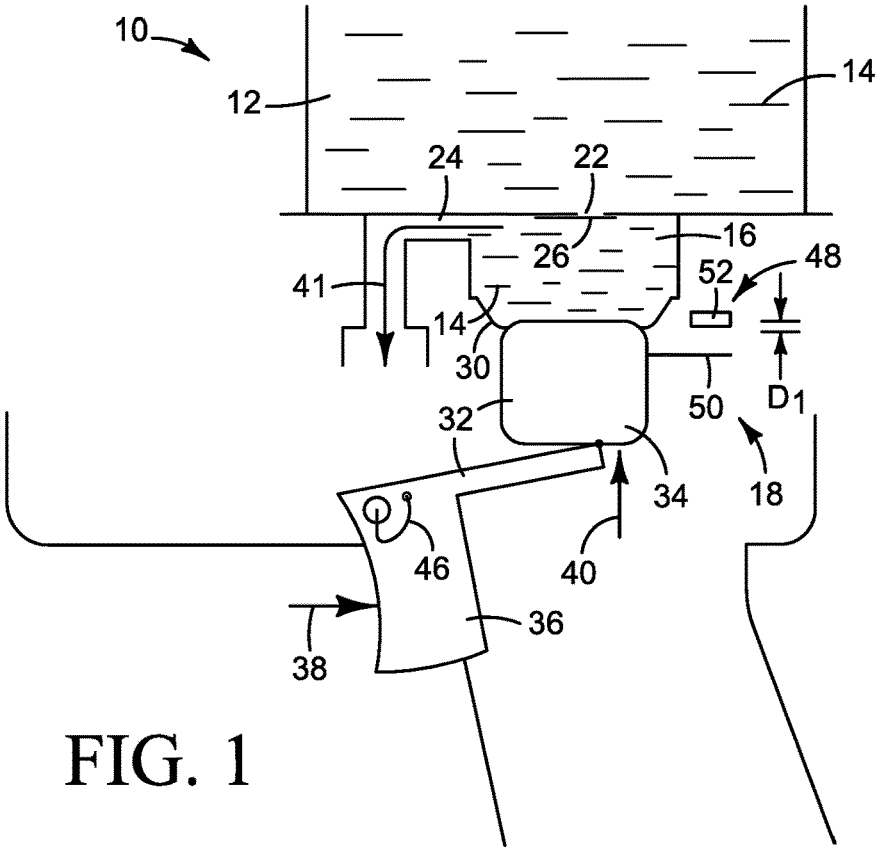

Some inkjet printheads do not hold a significant supply of ink. Ink is supplied to such printheads from a separate reservoir with a pump or gravity. A gravity fed supply may not be reliable in a handheld printer because the printer is not always upright, and a motor driven pump is not practical for many handheld printer applications due to size and power constraints. Also, it is particularly desirable in handheld printers to detect when the ink supply is low to avoid de-priming the printhead because of the difficultly priming the printhead.

A new ink delivery system has been developed for a handheld inkjet printer to reliably supply ink to the printhead from a separate reservoir and in a configuration that allows low ink detection. In one example, the system includes a manually actuated diaphragm pump to pull ink from the supply reservoir into a pressure chamber on the intake stroke, and to push ink from the pressure chamber toward the printhead on the outflow stroke. When the supply of ink in the reservoir is depleted, little or no ink is pulled into the pressure chamber on the intake stroke, reducing the volume of ink in the pressure chamber and increasing the displacement of the diaphragm on the next outflow stroke. A sensor senses the increased displacement of the diaphragm to signal the user that the printer is low on ink, and the user can stop printing while the printhead is still primed with ink. In one example, the pump actuator includes a trigger at the printer handle. The trigger is linked to a plunger that engages the diaphragm. Pulling the trigger pushes the plunger against the diaphragm to push ink out of the pressure chamber toward the printhead and releasing the trigger allows the diaphragm to rebound to pull ink into the pressure chamber from the reservoir.

Examples of the new delivery system are not limited to ink, or handheld printers, but may be implemented with other inkjet type dispensers and for other liquids. The examples described herein illustrate but do not limit the scope of the patent, which is defined in the Claims following this Description.

As used in this document, a "liquid" means a fluid not composed primarily of a gas or gases.

FIGS. 1-4 illustrate one example of a liquid delivery system 10 such as might be used in a handheld inkjet printer. Referring to FIGS. 1-4, system 10 includes a reservoir 12 to hold ink or another liquid 14, a pressure chamber 16 downstream from reservoir 12, and a manually actuated pump 18 to pump liquid 14 from reservoir 12 to a printhead 20 (shown in FIG. 5). As described in detail below, pump 18 pulls liquid 14 in to chamber 16 through an inlet 22 and pushes liquid out of chamber 16 through an outlet 24. In this example, a one-way valve 26 at chamber inlet 22 allows liquid 14 to flow out of reservoir 12 into chamber 16 but not back into reservoir 12. Valve 26 is shown as a flapper valve in the figures.

Figure 2:
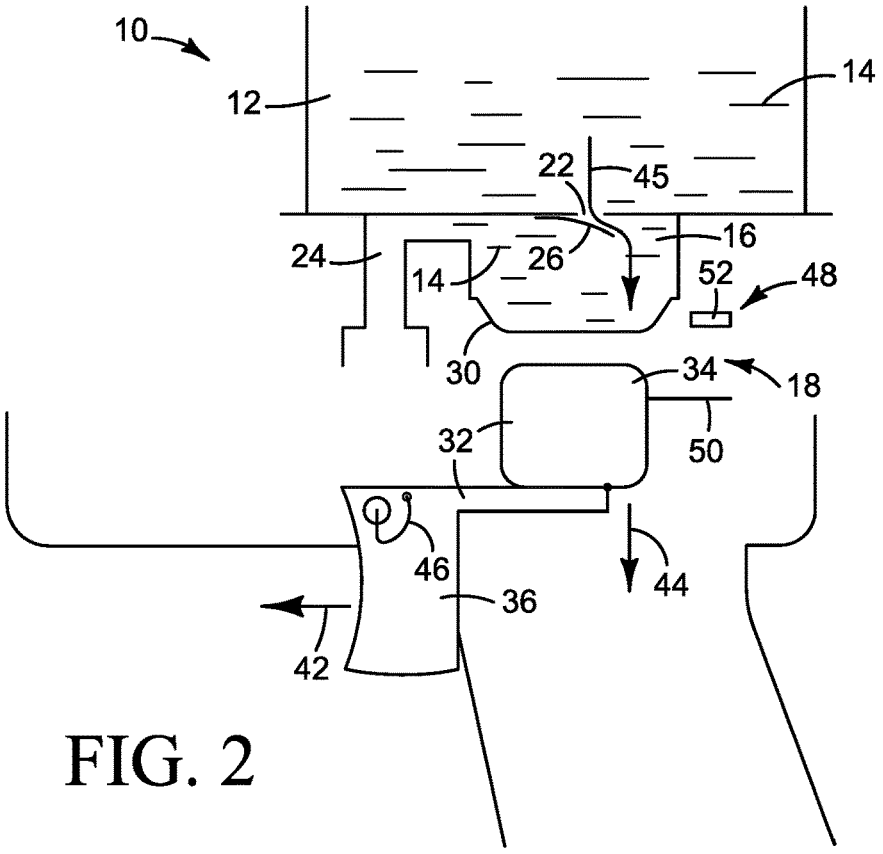

In the example shown in FIGS. 1-4, pump 18 is implemented as a diaphragm pump that includes a diaphragm 30 and an actuator 32 to move diaphragm 30. Actuator 32 includes a plunger 34 operatively connected to a trigger 36. As shown in FIG. 1, pulling trigger 36 (arrow 38) presses plunger 34 into diaphragm 30 (arrow 40), displacing diaphragm 30 a distance D1 to pressurize chamber 16 and push liquid 14 through outlet 24 (arrow 41) in an outflow stroke of pump 18. As shown in FIG. 2, when trigger 36 is released (arrow 42) plunger 34 moves down (arrow 44) at the urging of a spring or other suitable biasing mechanism 46, diaphragm 30 rebounds to expand chamber 16 and pull liquid 14 from reservoir 12 into chamber 16 through inlet 22 and valve 26 (arrow 45), in an intake stroke of pump 18. If pump 18 is capable of pulling liquid 14 through outlet 24 back into chamber 16 on the intake stroke, then a one-way valve may also be used at outlet 24 to allow liquid 14 to flow out of chamber 16 but not back into chamber 16 through outlet 24.

Figure 3:
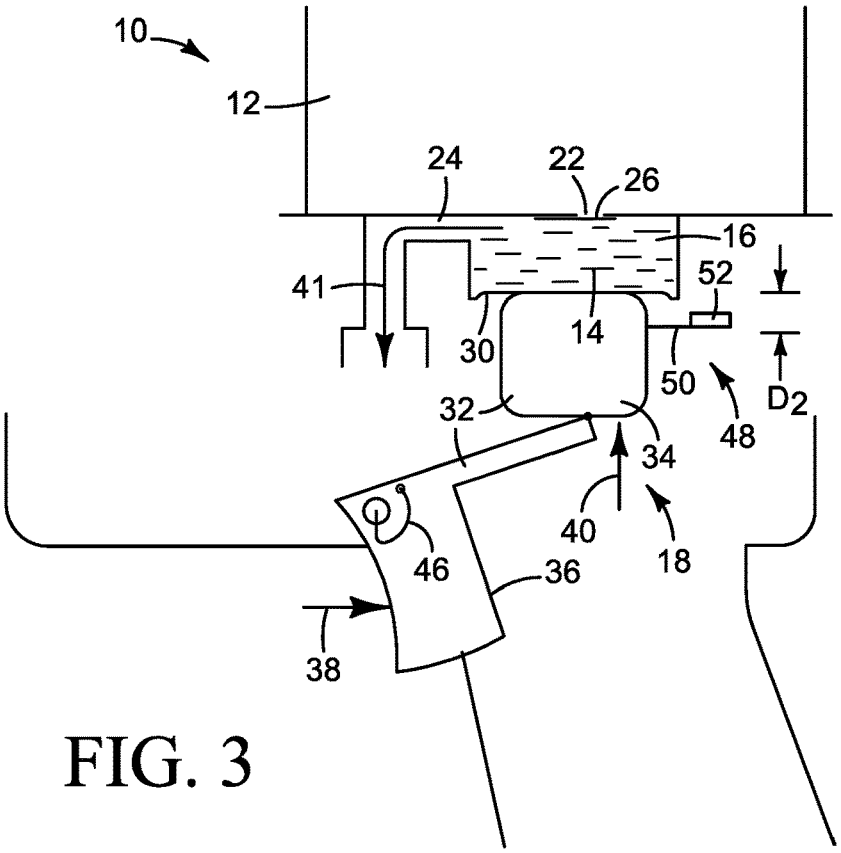
Figure 4:
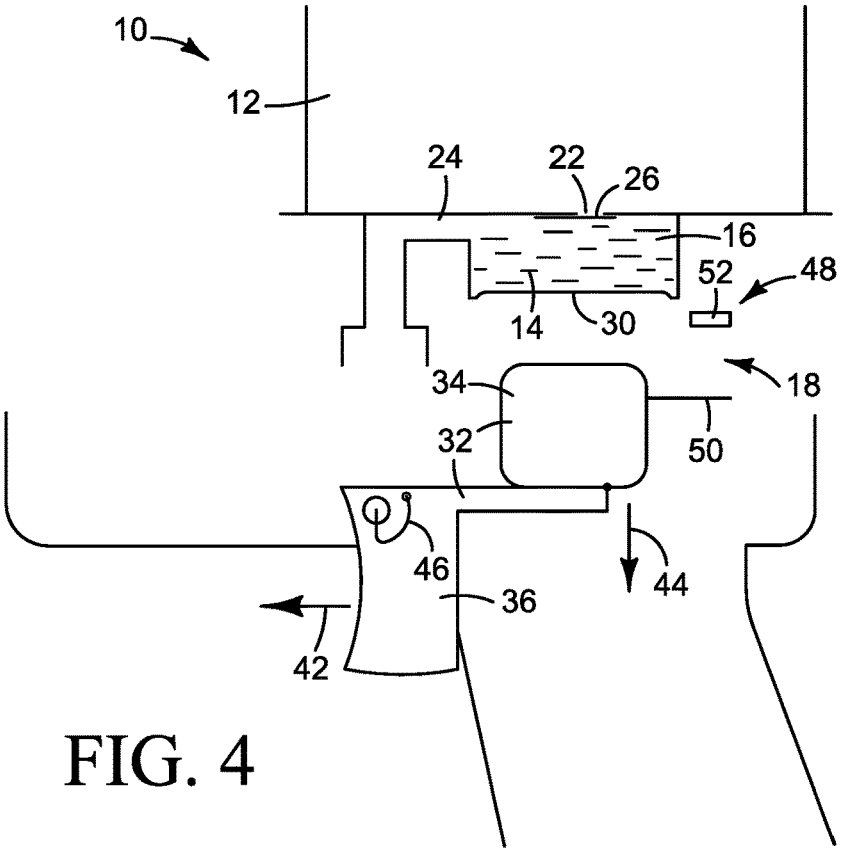

When the supply of liquid 14 in reservoir 12 is depleted, little or no ink is pulled into pressure chamber 16 on the intake stroke, reducing the volume of ink in chamber 16 and increasing the displacement of diaphragm 30 on the next outflow stroke to a displacement D2 as shown in FIG. 3. FIG. 4 shows a lesser volume of liquid 14 in pressure chamber 16 after trigger 36 is released. A sensor 48 senses a low liquid condition to signal the user that the device is low on liquid while the printhead is still primed. Any suitable sensor 48 may be used. For example, a sensor 48 may sense the displacement D2 of diaphragm 30 as an indication that reservoir 12 is empty or that the volume of liquid 14 in reservoir 12 has otherwise fallen below a threshold volume. In the example shown, sensor 48 is implemented as a position sensor with a flag 50 attached to plunger 34 and a contact switch 52 activated on contact with flag 50 when the displacement of diaphragm 30 reaches D2.

Figure 5:
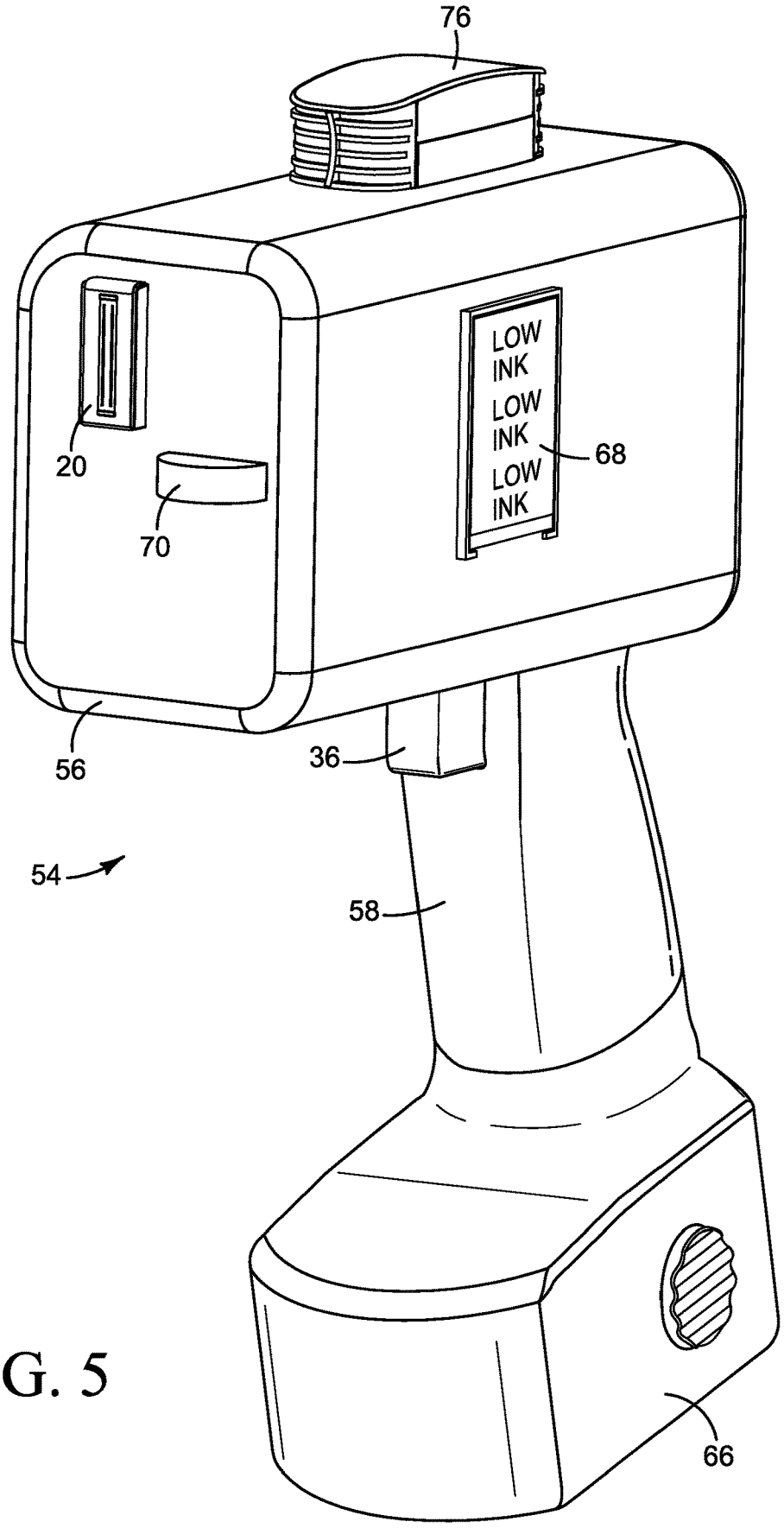
FIGS. 5 and 6 illustrate an example handheld inkjet printer implementing an ink delivery system such as the system shown in FIGS. 1-4. The housing is partially removed in FIG. 6 to show some of the internal parts in more detail.
Figure 6:
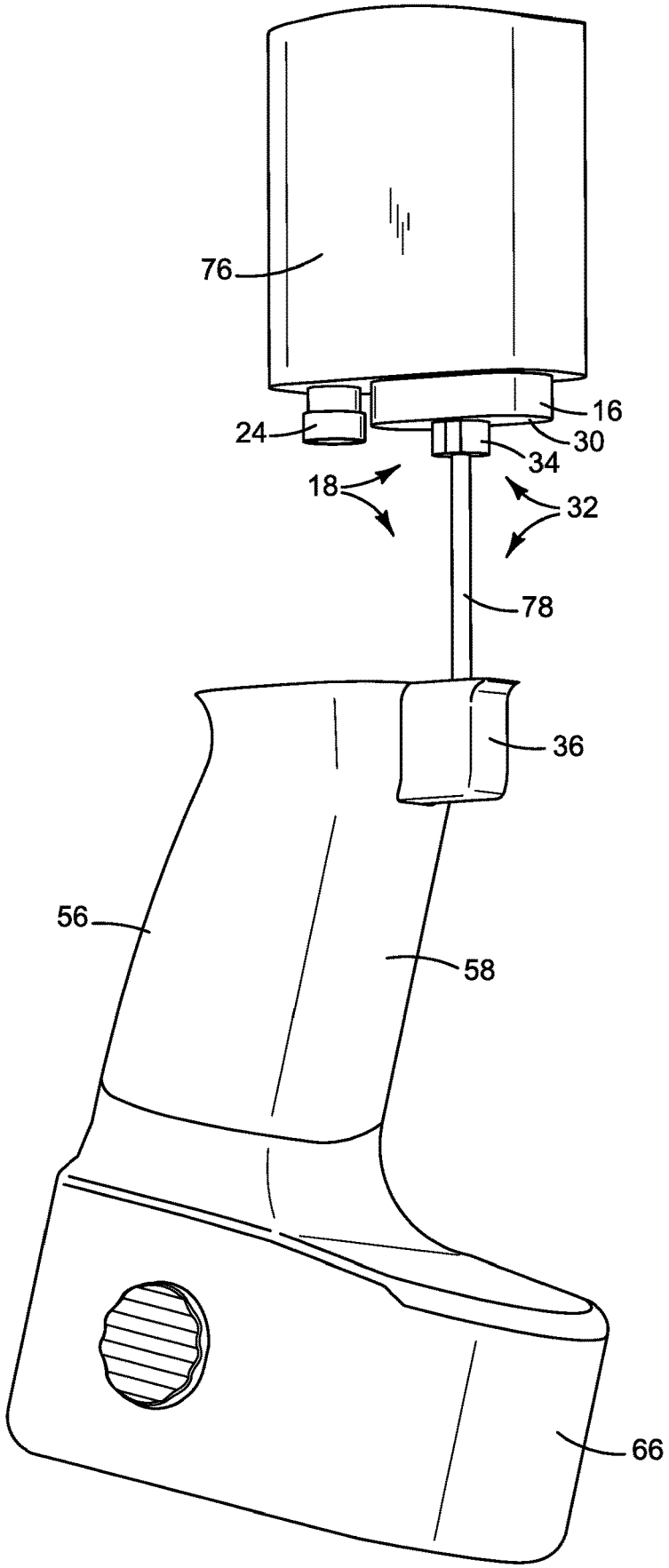
Figure 7:
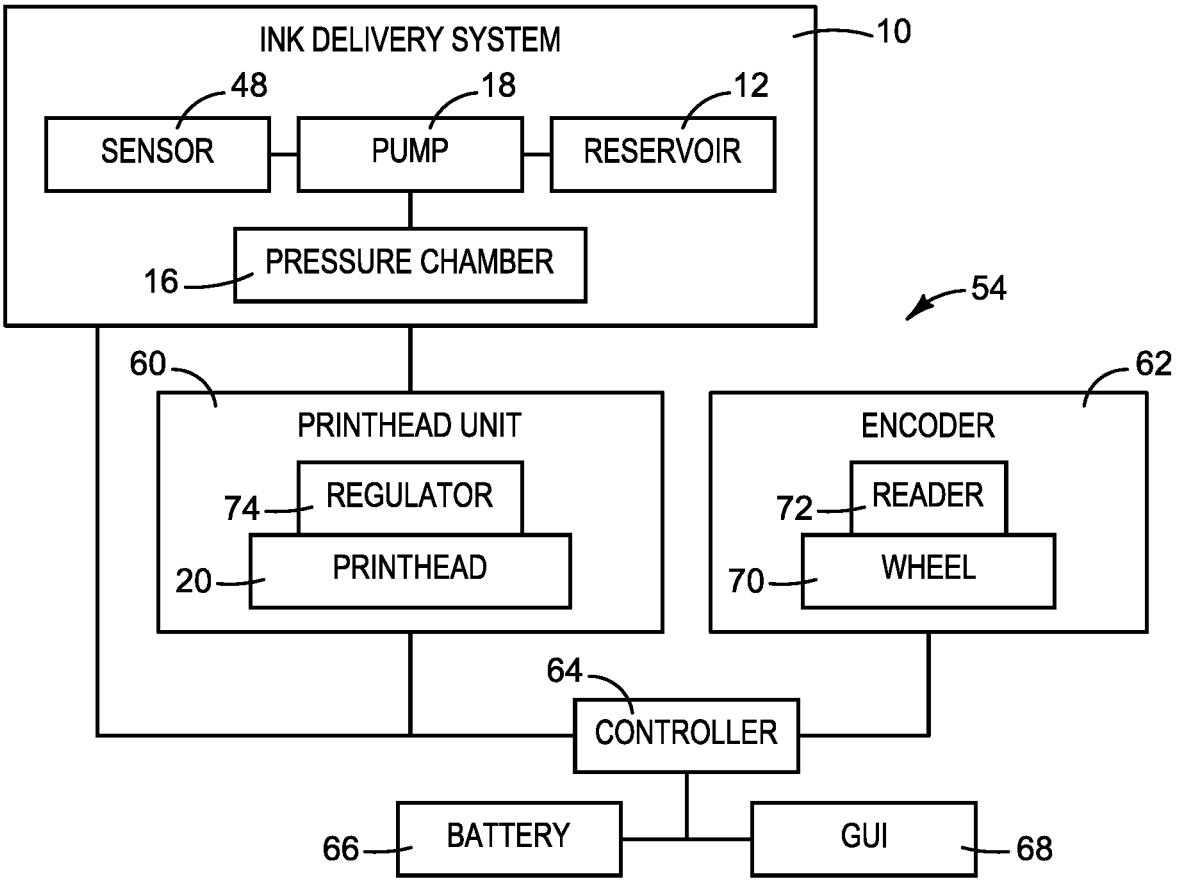
FIG. 7 is a block diagram illustrating an example handheld printer such as that shown in FIGS. 5 and 6.

FIGS. 5 and 6 are perspectives illustrating one example of a handheld inkjet printer 54 implementing an ink delivery system such as a system 10 shown in FIGS. 1-4. FIG. 6 illustrates printer 54 with the housing partially removed to show some of the internal parts in more detail. FIG. 7 is a block diagram of a handheld printer 54 shown in FIGS. 5 and 6. Referring to FIGS. 5-7, printer 54 includes a housing 56 with a hand grip 58 and a printhead unit 60, an encoder 62, an ink delivery system 10, a controller 64, and a battery 66 supported in housing 56. Controller 64 represents the processing and memory resources, programming, and the electronic circuitry and components needed to control the operative components of printer 54. In this example, printer 54 includes a graphical user interface 68 operatively connected to controller 64.

Printer 54 also includes a low ink sensor 48 to sense a low ink condition, as described above with reference to FIGS.

1-4. Sensor 48 signals controller 64 when ink is low so that the user may be notified of the low ink condition, for example by displaying a LOW INK warning on graphical user interface 68. An audible or other notification to the user could be used.

Encoder 62 includes an encoder wheel 70 and a reader 72 to read the position of wheel 70. In operation, encoder wheel 70 engages the surface to be printed. Wheel 70 turns as the printer is moved along the surface. Reader 72 reads the position of wheel 70 and controller 64 activates printhead 20 according to position signals from reader 72. to print a bar code or other image on the surface.

As shown in FIG. 7, printhead unit 60 includes a printhead 20 and a flow regulator 74 to help control the flow of ink to printhead 20. A regulator 74 in a printhead unit 60 may be capable of delivering a small volume of ink to printhead 20 independent of ink resupply from system 10. Although it is expected that a handheld printer 54 usually will include a single printhead 20, it may desirable (and feasible) in some handheld printers to include multiple printheads 20 with one or multiple flow regulators 74.

Battery 66 supplies power to controller 64 and to printhead 20, encoder 62, and sensor 48 directly or indirectly through controller 64. Battery 66 may be implemented, for example, as a removable rechargeable battery.

Figure 10:
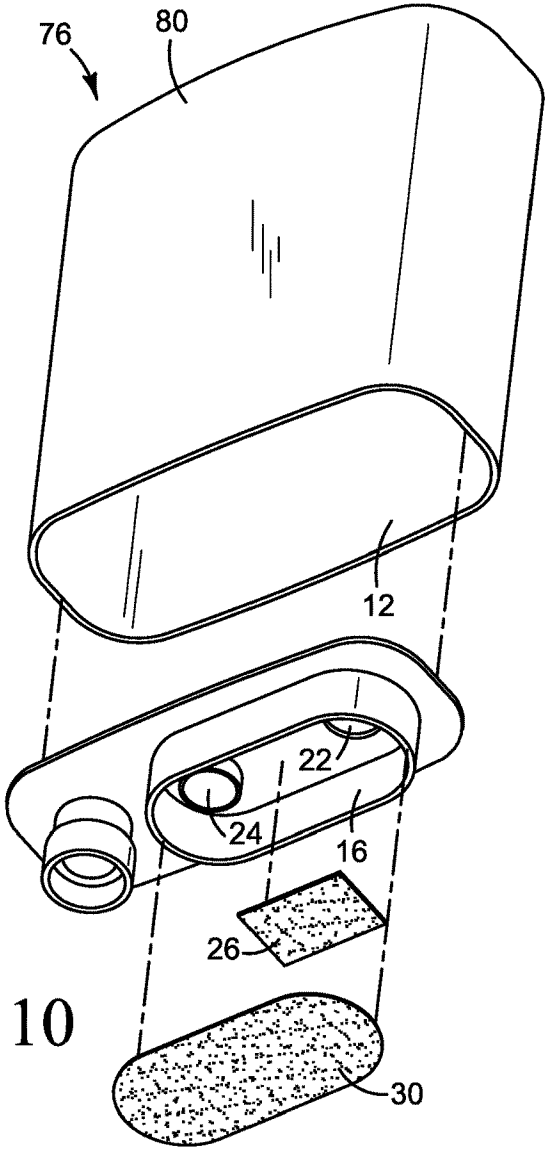
FIGS. 8-10 show an example replaceable ink cartridge such as might be used in a handheld printer shown in FIGS. 5-7.
Figure 9:
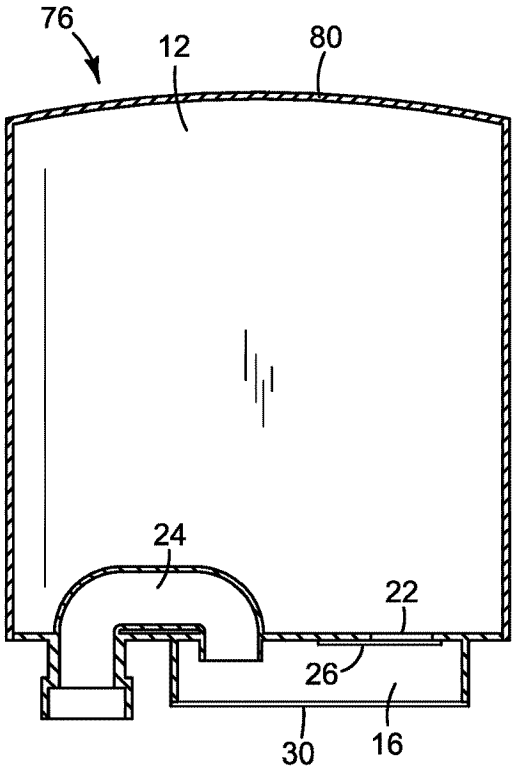
Figure 8:
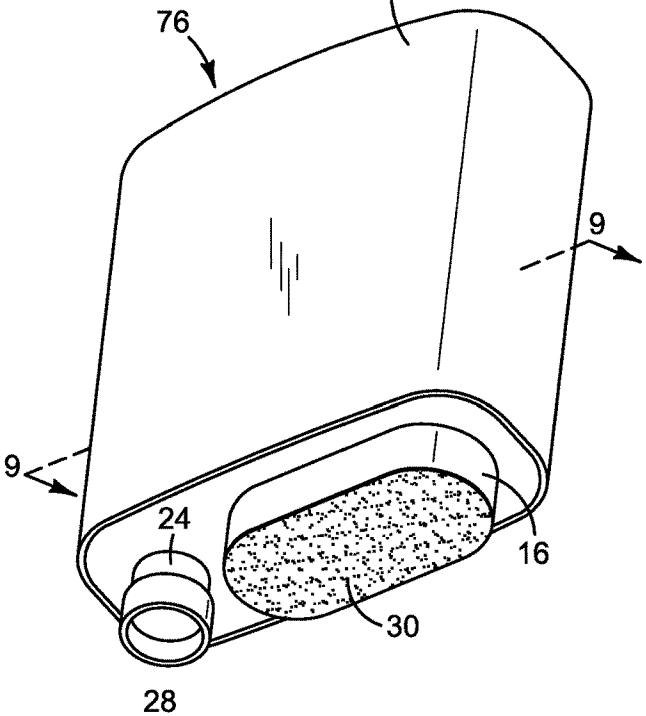

Referring to FIG. 6, the ink delivery system includes a replaceable ink cartridge 76 with reservoir 12, pressure chamber 16, and a diaphragm pump 18. In this example, pump actuator 32 includes a connecting rod 78 connecting trigger 36 to plunger 34 to alternately push and release the plunger when pulling and releasing the trigger, as described above with reference to FIGS. 1-4. FIGS. 8-10 show ink cartridge 76 in more detail. Referring to FIGS. 8-10, ink is held in reservoir 12 inside a container 80. Pressure chamber 16 extends along the bottom of container 80 with inlet 22 from reservoir 12 and outlet 24 to the printhead or printhead unit. Flapper valve 26 may be formed, for example, by a sheet of flexible material heat staked along part of its perimeter to the supporting structure on container 80. Similarly, diaphragm 30 may be formed by a sheet of flexible material heat staked to container 80 around the perimeter of pressure chamber 16.

Although a diaphragm pump 18 is shown and described, other types of positive displacement manually actuated pumps may be used.

As noted at the beginning of this Description, the examples shown in the figures and described above illustrate but do not limit the scope of the patent, which is defined in the following Claims.

"A" and "an" as used in the Claims means one or more.

The invention claimed is:

1. A liquid delivery system for an inkjet type dispenser, comprising:

a reservoir to hold liquid;

a chamber downstream from the reservoir;

a one-way valve to allow the flow of liquid from the reservoir into the chamber and to block the flow of liquid from the chamber back into the reservoir; and a manually actuated pump, in which hand movements physically impel the pump, to pull liquid from the reservoir into the chamber through the valve and to push liquid from the chamber toward a printhead.

2. The system of claim 1, comprising a sensor to sense a volume of liquid in the reservoir below a threshold volume.

3. The system of claim 2, wherein the sensor is to sense that the pump, when actuated, is unable to pull liquid from the reservoir.

4. The system of claim 2, wherein the pump is a diaphragm pump and the sensor is configured to sense a displacement of the diaphragm.

5. The system of claim 4, comprising a pump actuator that includes a trigger operatively connected to the diaphragm such that pulling the trigger displaces the diaphragm to pressurize the chamber to push liquid toward the printhead.

6. A liquid delivery system for an inkjet type dispenser, comprising:

a manually actuated diaphragm pump, in which hand movements physically impel the pump;

an inlet to the pump from a liquid supply reservoir;

an outlet from the pump to a printhead; and a sensor to sense a displacement of the diaphragm.

7. The system of claim 6, comprising a pressure chamber operatively connected to the pump between the inlet and the outlet.

8. The system of claim 7, comprising a valve to allow the flow of liquid from the reservoir into the pressure chamber through the inlet and to block the flow of liquid from the pressure chamber back into the reservoir through the inlet.

9. The system of claim 8, comprising a pump actuator that includes a trigger operatively connected to the diaphragm such that pulling the trigger displaces the diaphragm to pressurize the chamber to push liquid toward the printhead.

10. A handheld inkjet printer, comprising:

a housing including a hand grip;

a controller;

a printhead supported in the housing and operatively connected to the controller;

an encoder supported in the housing to signal the controller to activate the printhead;

a replaceable ink cartridge supported in the housing and having a reservoir to hold ink;

a pump to pump ink from the reservoir to the printhead; and a trigger mounted to the hand grip and operatively connected to the pump such that pulling the trigger physically impels the pump.

11. The printer of claim 10, comprising a sensor to sense a volume of liquid in the reservoir below a threshold volume.

12. The printer of claim 11, wherein the pump is a diaphragm pump and the sensor is configured to sense a displacement of the diaphragm.

13. The printer of claim 11, comprising a battery to supply power to the controller and to the printhead, the encoder and the sensor.

* * * * *